US005409208A

United States Patent [19]

Schmid

[11] Patent Number: 5,409,208

[45] Date of Patent: Apr. 25, 1995

[54] DEVICE FOR CONVEYING SHEETS FROM A PRINTING PRESS TO A SHEET PILE

[75] Inventor: Gotthard Schmid, Nussloch, Germany

[73] Assignee: Heidelberger Druckmaschinen, Heidelberg, Germany

[21] Appl. No.: 185,593

[22] Filed: Jan. 21, 1994

[30] Foreign Application Priority Data

Jan. 27, 1993 [DE] Germany ..... 43 02 129.8

[51] Int. Cl.[6] ..... B65H 29/04

[52] U.S. Cl. ..... 271/204; 271/277

[58] Field of Search ..... 271/275, 276, 277, 183, 271/204, 205

[56] References Cited

U.S. PATENT DOCUMENTS 3,081,082 3/1963 Spooner et al. ..... 271/183
4,517,575 5/1985 Kakimoto et al. ..... 271/277
4,534,550 8/1985 Reist ..... 271/183

FOREIGN PATENT DOCUMENTS 333545 12/1958 Switzerland ..... 271/277
562462 5/1975 Switzerland ..... 271/276

*Primary Examiner*—H. Grant Skaggs
*Attorney, Agent, or Firm*—Herbert L. Lerner; Laurence A. Greenberg

[57] ABSTRACT

Device for conveying sheets from a printing press to a sheet pile includes revolving endless conveyor members looped about at least two rotating members having respective horizontal axes of rotation disposed parallel to one another, mechanical grippers carried by the endless conveyor members for gripping only respective leading edges of sheets, the endless conveyor members having a respective upper side moving along a conveying path in a given conveying direction for carrying thereon sheets conveyable away from the printing press, and a device disposed in the conveying path for smoothing the sheet, the smoothing device being cyclically movable reciprocatingly in a direction perpendicular to the given conveying direction of the sheets.

5 Claims, 1 Drawing Sheet

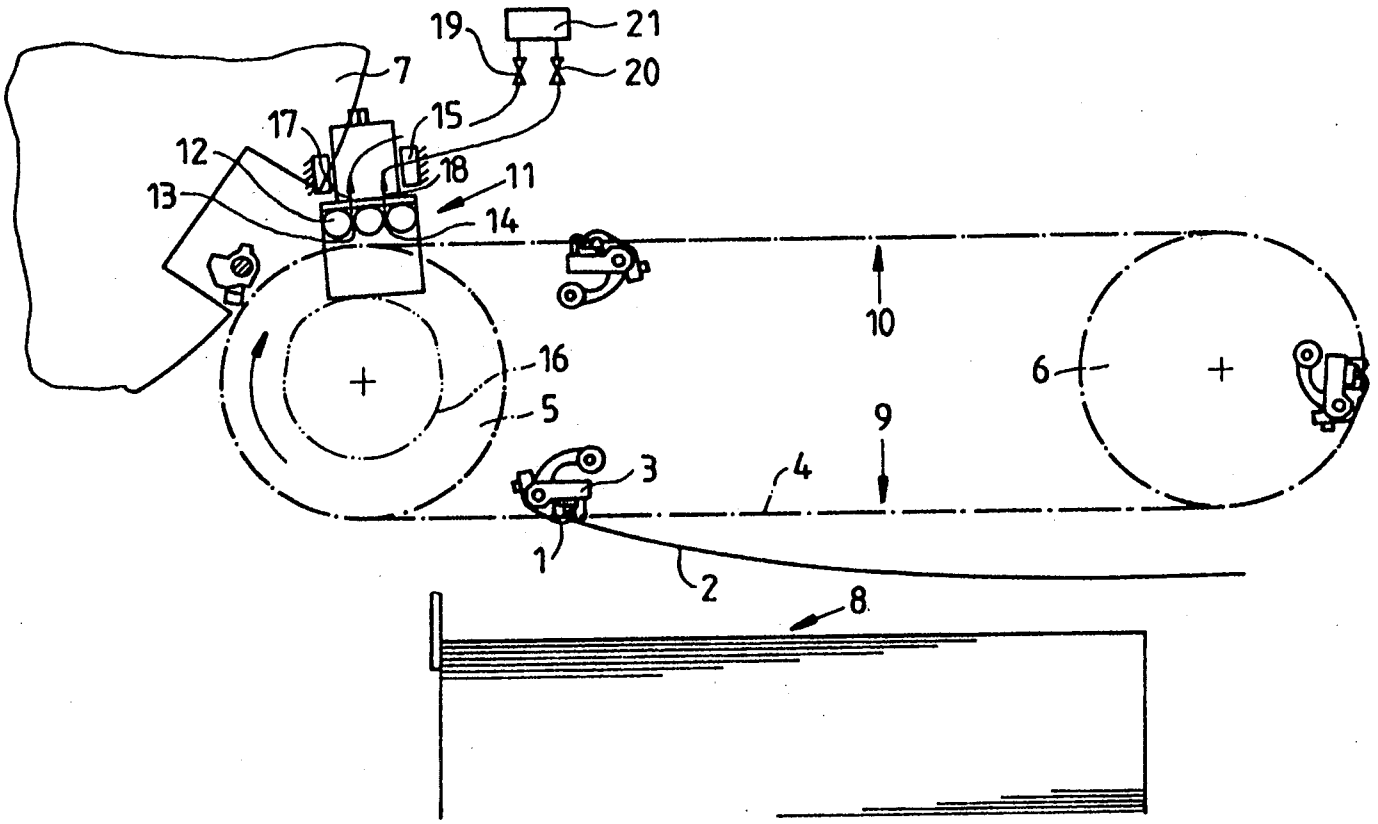
1
2
3
4
5
6
7
8
9
10
11
12
13
14
15
16
17
18
19
20
21

DEVICE FOR CONVEYING SHEETS FROM A PRINTING PRESS TO A SHEET PILE

SPECIFICATION

The invention relates to a device for conveying sheets from a printing press to a sheet pile and, more particularly, to a delivery for sheet-fed printing-presses wherein sheets are held by respective front or leading edges thereof in grippers which are disposed on moving endless chains or belts. The chains or belts are laid over or looped about rotating members having respective axes of rotation which are horizontally disposed parallel to one another, one of the rotating members, such as a sprocket wheel, being couplable to a drive. The invention also relates to a delivery wherein the sheets are conveyed away from the printing press on an upper side or strand of endless chains or belts carrying the grippers. To provide assistance or support in the sheet transport, in a device of the foregoing general type, at least one smoothing device is provided in a conveying path of the sheets.

Published East German Patent Document DD 298 226 A5 describes a device for smoothing sheets in sheet deliveries. The device is disposed in the lower side or strand of a chain delivery. The device is formed of a starting plate, a suction tube, and a runoff plate, which are disposed fixed in position over the entire width of the sheet. The device is so constructed that a collision of the sheet with the following gripper carriage is avoided. To cause the sheet to press against the smoothing device, a high negative pressure is generated in the suction tube and is maintained during the smoothing.

A disadvantage of the foregoing heretofore known smoothing device is that it has a rather high air consumption when suction is applied to the sheet. In chain deliveries wherein the sheet is transported on an upper side or strand, the air consumption would be even greater if such a smoothing device were used, because suction would then have to be applied to the sheet counter to the action of gravity. Moreover, because of the high suction, there is a danger that a sheet printed on both sides will be smeared or damaged at the moment suction is applied thereto.

It is accordingly an object of the invention to provide a device for conveying sheets from a printing press to a sheet pile wherein a smoothing device is provided which has only very low air consumption and only a slight tendency towards smearing.

With the foregoing and other objects in view, there is provided, in accordance with the invention, a device for conveying sheets from a printing press to a sheet pile, comprising revolving endless conveyor members looped about at least two rotating members having respective horizontal axes of rotation disposed parallel to one another, mechanical grippers carried by the endless conveyor members for gripping only respective leading edges of sheets, the endless conveyor members having a respective upper side moving along a conveying path in a given conveying direction for carrying thereon sheets conveyable away from the printing press, and a device disposed in the conveying path for smoothing the sheet, the smoothing device being cyclically movable reciprocatingly in a direction perpendicular to the given conveying direction of the sheets.

In accordance with another feature of the invention, the endless conveyor members are chains, and the rotating members are sprocket wheels.

In accordance with an alternative feature of the invention, the endless conveyor members are belts.

In accordance with a further feature of the invention, the conveying device includes a linear guide wherein the smoothing device is seated, and a cam for controlling the reciprocating movement of the smoothing device.

In accordance with an added feature of the invention, the conveying device includes means for superimposing a movement in the given conveying direction upon the movement of the smoothing device in the direction perpendicular to the conveying direction.

In accordance with an additional feature of the invention, the linear guide in which the smoothing device is seated is disposed so as to be swivelable about an axis extending perpendicularly to the given conveying direction of the sheets.

In accordance with yet another feature of the invention, the smoothing device, as viewed in the given sheet-conveying direction, is disposed in a starting region of the upper side of the grippers-transporting endless conveyor members.

In accordance with a concomitant feature of the invention, the reciprocating movement of the smoothing device has an upper reversal point having a height adjustable for transfer to the grippers.

Thus, the smoothing device may be guided rectilinearly, and the reciprocating movement may be controlled by a cam. The reciprocating movement perpendicularly to the given conveying direction of the sheets may have a movement in the conveying direction superimposed thereon, in which case the linear guide in which the smoothing device is seated may be disposed so that it is swivelable about an axis perpendicular to the given conveying direction. The smoothing device, as viewed in the given sheet-conveying direction, may be disposed at a starting region of the upper side of the endless chains or belts transporting the grippers. It is advantageous if the height of the upper reversal point of the smoothing device is adjustable for transfer to the grippers.

Because the smoothing device moves towards the sheet for applying suction to the sheet, the distance that the suction action must cover or overcome is shortened, so that the requirement for suction air is low. The sheet is gently placed against the smoothing device, so that smearing can be avoided to the greatest extent which is possible. Control of the reciprocating movement is effected in a manner that the smoothing device itself, as well as the respective sheet, do not collide with parts of the delivery.

Other features which are considered as characteristic for the invention are set forth in the appended claims.

Although the invention is illustrated and described herein as embodied in a device for conveying sheets from a printing press to a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing, which is a diagrammatic side elevational view of a chain delivery for a sheet-fed printing press incorporating the conveying device according to the invention.

Referring now to the figure of the drawing, there is shown therein a delivery including mechanical grippers 1 wherein a front or leading edge of a respective sheet 2 to be delivered or deposited is held. A plurality of grippers 1 are respectively disposed on a gripper bar 3 transversely to the transport or sheet-conveying direction, three of the grippers 1 being shown secured to two parallel-extending chains 4. The chains 4 travel over sprocket wheels 5 and 6 having respective axes of rotation disposed horizontally and parallel to one another. The sheets 2 are transported from a last impression cylinder 7 of a sheet-fed printing press onto a sheet pile 8 which is disposed below a lower side or strand 9 of the chain delivery. One of the sprocket wheels 5 or 6 is coupled with a non-illustrated conventional drive. A smoothing device 11 is provided in a starting region of an upper side or strand 10 of the chains 4. The smoothing device 11 includes two or three tubes 12, disposed over the width of a sheet 2 to be conveyed and forming or defining one or two smoothing gaps 13 and 14, as applicable. The smoothing device 11 is received in a linear guide 15 having a guide direction which is inclined relative to the vertical in order to attain optimal smoothing and guiding action. The smoothing device 11 is disposed so as to move reciprocatingly in the linear guide 15, this motion being controlled by a cam 16. In a region wherein one of the grippers 1 is moved past the smoothing device 11, the smoothing device 11 is positioned by the cam 16 at its farthest location away from the grippers 1. The smoothing device 11 may communicate with a source of suction, so that suction action takes place through the smoothing gaps 13 and 14 in the direction of the arrows 17 and 18. The strength or magnitude of the vacuum in the smoothing gaps 13 and 14 is adjustable via valves 19 and 20. The valves 19 and 20 communicate with a vacuum generator 21.

I claim:

1. Device for conveying sheets from a printing press to a sheet pile, comprising revolving endless conveyor members looped about at least two rotating members having respective horizontal axes of rotation disposed parallel to one another, mechanical grippers carried by said endless conveyor members for gripping only respective leading edges of sheets, said endless conveyor members having a respective upper side moving along a conveying path in a given conveying direction for carrying thereon sheets conveyable away from the printing press, and a device disposed in said conveying path for smoothing the sheet, said smoothing device being cyclically movable reciprocatingly in a direction perpendicular to said given conveying direction of the sheets.

2. Device according to claim 1, including a linear guide wherein said smoothing device is seated, and a cam for controlling said reciprocating movement of said smoothing device.

3. Device according to claim 1, wherein said smoothing device, as viewed in said given sheet-conveying direction, is disposed in a starting region of said upper side of said grippers-transporting endless conveyor members.

4. Device according to claim 1, wherein said endless conveyor members are chains, and said rotating members are sprocket wheels.

5. Device according to claim 1, wherein said endless conveyor members are belts.

* * * * *